United States Patent [19]

Perissinotto

[11] Patent Number: 4,725,246

[45] Date of Patent: Feb. 16, 1988

[54] CONNECTOR FOR INTERCONNECTING FLAT CABLES

[75] Inventor: Claudio Perissinotto, Udine, Italy

[73] Assignee: Solari & C/Udine Societa per Azioni, Italy

[21] Appl. No.: 914,810

[22] Filed: Oct. 3, 1986

[30] Foreign Application Priority Data

Oct. 8, 1985 [IT] Italy ..... 22389 A/85

[51] Int. Cl.[4] ..... H01R 4/24

[52] U.S. Cl. ..... 439/391

[58] Field of Search ..... 339/98, 97 R, 97 P, 339/99 R

[56] References Cited

U.S. PATENT DOCUMENTS 4,066,321 1/1978 Villagon ..... 339/98

4,075,417 2/1978 Neale, Sr. ..... 339/98

4,461,528 7/1984 Durand et al. ..... 339/98

*Primary Examiner*—Joseph H. McGlynn

*Attorney, Agent, or Firm*—Brooks Haidt Haffner & Delahunty

[57] ABSTRACT

A connector for interconnecting the flat wires of flat cables having a band of insulation in which the wires are embedded. The connector comprises a strip of foldable insulating material having seats which face each other when the strip is folded and which have metal plates therein with points or prongs which, upon folding and pressing of the opposed portions of the strip toward each other with the cables therebetween, causes the points to engage the wires of the cables and form both mechanical connections between the connector and the wires and electrical connections between the wires.

16 Claims, 11 Drawing Figures

CONNECTOR FOR INTERCONNECTING FLAT CABLES

The present invention relates to a connector for interconnecting flat electrical cables, specifically, cables comprising two or more parallel, flat and coplanar wires or conductors embedded in a band-like insulating structure.

Cables of this kind are preferably, but not exclusively, used for the transmission of electrical power in undercarpet applications, and for this reason, the present invention will be described with particular reference to flat cables used to convey electrical power, but it will be apparent that the connectors of the invention may be used to interconnect other types of flat cables.

Several different types of connectors between flat cables are already known, and such connectors can provide a butt joint, namely, a connection of longitudinally aligned wires for extending the length of a flat cable or can provide a connection between transversely extending wires to carry out a branch connection inside a plant. Also, the flat cables can be differently built up and sized, although some of their essential structures are not changed.

First of all, the flat cables may comprise various numbers of wires, such as three or five wires, according to the particular requirements. For instance, the wires of a three-wire flat cable may be respectively used for phase, neutral and earth.

A five-wire flat cable can be used for the same purpose, utilizing only three of the five available wires, or for connecting two single-phase voltage systems having a common earth wire.

Further, when branch connections are to be made, it may be necessary to have a different arrangement of the wires with respect to that of the main supply line.

The known types of connectors are constructed as a function of the cable size and/or of the number of wires, as required by the kind of connection (butt joint or transverse joint) or in accordance with other particular requirements, such as, for example, for wires crossing at a branch. The conventional connectors have, therefore, the typical disadvantages of components which are made for specific purposes, i.e. a high cost and poor service versatility which are often in combination with a complicated construction and/or use difficulties.

A further disadvantage of the conventional connectors is their thickness, often caused by the overlap of the two cables to be connected, so that the resulting connection is rather bulky.

Moreover, the application of the known connectors to the cables involves a substantial number of operations which results in a rather long installation time. The present invention has, as one object, the providing of a connector for flat cables which comprise substantially flat wires, such connector being without the stated disadvantages, being easily constructed and installed, being usable for flat cables of various kind and providing the possibility of varying the connections between the wires.

In accordance with the present invention, the connector for electrical cables composed of two or more flat, coplanar and parallel wires embedded in a band-like insulating structure comprises a strip of insulating material foldable along a transverse line, said strip being provided on one face with parallel seats and means intended to mutually engage when the strip is folded, and a plurality of metal plates, each housed in a seat and secured to the strip. Each plate is provided with means able to perforate the cable insulation and to obtain a permanent electrical connection between the plate and the flat wire of the cables being interconnected.

In a preferred embodiment of the invention, intended for making a butt joint between two flat cables, the seats are constituted by rectangular grooves extending parallel to the folding line and all having the same length.

In a further embodiment of the invention, intended for making branch connections between flat cables, said seats are constituted by rectangular grooves extending perpendicularly to the transverse folding line, the seats for the metal plates being of different lengths.

Other objects and advantages of the present invention will be apparent from the following detailed description of the presently preferred embodiments thereof, which description should be considered in conjunction with the accompanying drawings in which.

The structure of a connector for flat cables each comprising five wires, in particular, flat wires suitable for conveying electric power, will be described in detail in connection with FIGS. 1–9.

The connector illustrated in FIGS. 1–9 is of the type intended for making a butt joint between the two flat cables 20, 21 (see FIG. 1), each of which comprises five flat wires 22 embedded in a mass 23 of insulating material, such as a plastomeric or elastomeric material extruded, calendered or otherwise applied around the wires 22.

Figure 1:
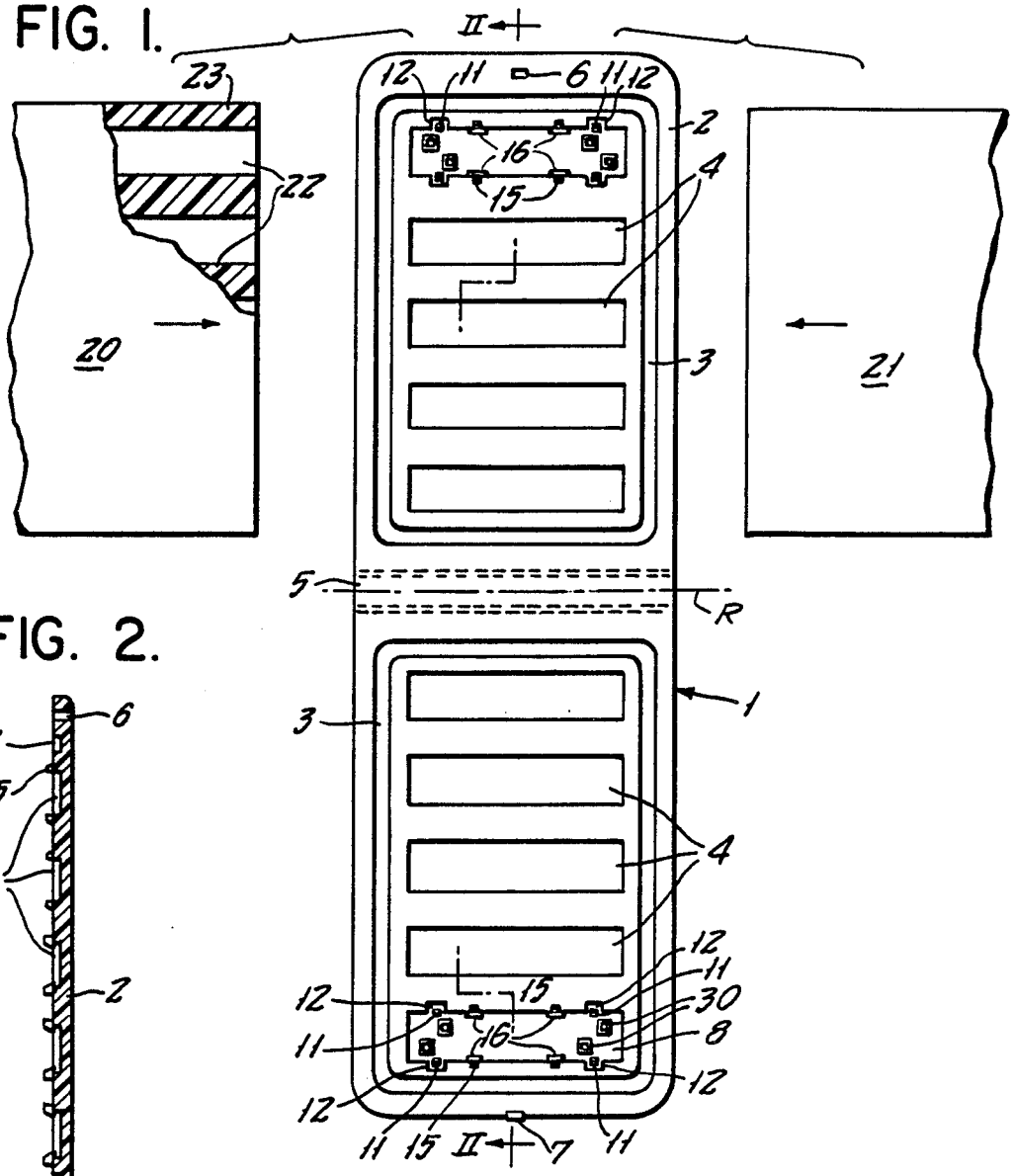
FIG. 1 is a plan view of a connector according to the invention for making a butt joint between two flat cables, in association with a pair of flat cables, one of the cables having its insulation partially cut-away to show the wires thereof.
Figure 2:
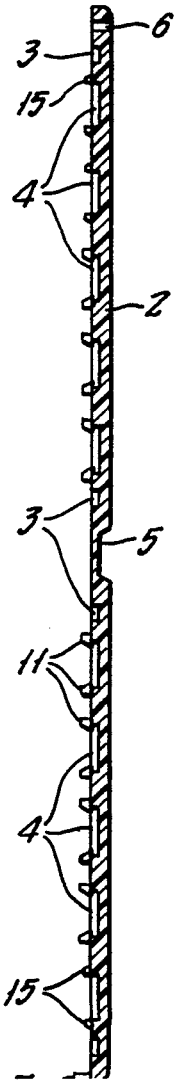
FIG. 2 is a section taken along line II—II in FIG. 1.

With reference to FIG. 1 which shows a connector 1 before it is applied to the cable, namely, is in "opened" condition, the connector 1 comprises a strip 2 of insulating material and a plurality of metal connector plates, only one of which, the connector 8, is illustrated in FIG. 1, which are received and held in seats 4 in the strip 2.

The strip 2 of insulating material preferably is obtained by molding an appropriate plastic material, with the simultaneous formation of all the functional elements of the strip 2 on only one face, as shown in FIG. 1.

The strip can be folded along a transverse folding line R which, in this embodiment, preferably is an axis of symmetry for the connector structure and divides the strip into two substantially identical parts. Said folding line is obtained by a transverse thinning 5 of the strip 2, which allows easy folding and overlapping of the two parts at the axis of symmetry. As seen in FIG. 1, each part has a length slightly exceeding the width of the flat cables 20 and 21.

Of course, the transverse folding line can be obtained in other ways, such as, by engraving, removal of material, etc.

Securing elements are provided at the ends of the strip 2, such as, by a recess or aperture 6 and a tooth 7 which extends into the aperture 6 when the connector 1 is folded around the axis R. The main function of the securing elements is that of aligning the two strip halves carrying the cables to be connected and of maintaining the whole in a firm position when a pressure which firmly secures the parts together and provides the desired electric connections is applied.

Figure 3:
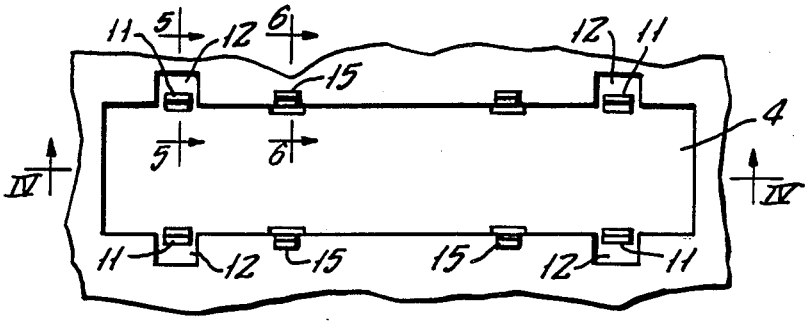
FIG. 3 is an enlarged view of one of the seats provided in the connector shown in FIG. 1.
Figure 4:
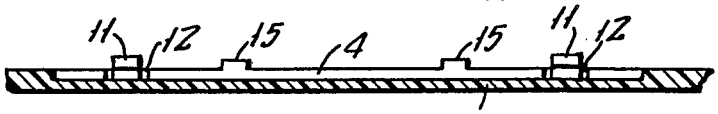
FIG. 4 is a section taken along line IV—IV in FIG. 3.

Each of the parts or halves, in which the strip 2 is divided by the folding line R has five parallel seats 4, each of which, preferably, has the same length, which are surrounded by a peripheral channel 3. The seats 4 are better seen in FIG. 2 and in the enlarged view of FIG. 3, FIG. 3 illustrating only the seats 4. Each seat 4 is constituted by a substantially rectangular groove provided with anchoring elements 11 and 15 arranged peripherally of the groove forming the seat 4. The anchoring elements 11 and 15 are used to firmly secure the connecting plates 8 in position, one of the plates being shown in greater detail in FIGS. 7–9.

Figure 5:
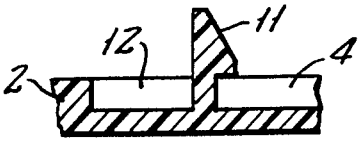
FIGS. 5 and 6 are enlarged, fragmentary sectional views showing the details of two anchorage elements provided on the connector.

An anchoring element 11 is illustrated in FIG. 5 and is constituted by an elastic tooth which extends from the bottom of groove of a seat 4. Outwardly of each tooth, there is a recess 12.

Figure 6:
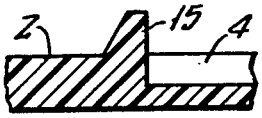

The anchoring element 15 is shown in FIG. 6 and is constituted by a projection or protuberance of trapezoidal section which extends above the wall of the groove of the seat 4 and at its inner side, is co-extensive with such wall. The element 15 is a guide and provides a position reference for the plate 8.

Each of the seats 4 of the connector 1 shown in FIG. 1 have four anchoring elements 11 and four anchoring elements 15, symmetrically arranged, with the elements 11 farther from the midpoint of the seat 4.

Figure 9:
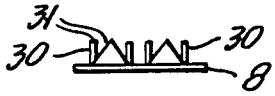
FIGS. 7, 8 and 9 are, respectively, enlarged plan, side and end views of a metal plate of the type used in the connector of FIG. 1.
Figure 7:
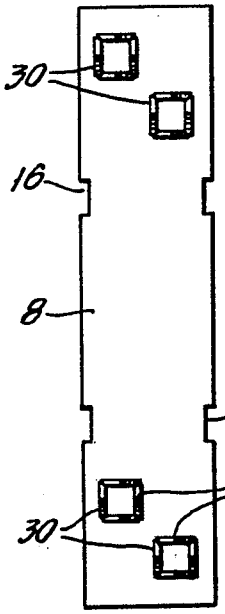
Figure 8:
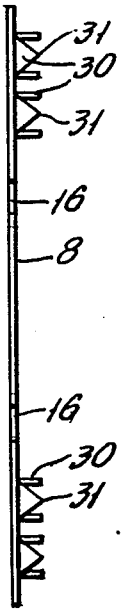

FIGS. 7, 8 and 9 illustrate one of the connecting plates 8. Each plate 8 is formed by a metallic strip 8 and is provided, on one face, with means for perforating the insulation of the flat cables 20 and 21 and engaging the wires of the cables. In the illustrated embodiment, said means for piercing the cable insulation is constituted by two pairs of piercing elements 30, each formed by four points 31 of generally triangular shape protruding from the plate 8, and preferably, obtained by shearing during the construction of said plate.

In proximity to each plate end, there is a pair of elements 30, preferably not arranged side-by-side, each comprising four triangular points 31 obtained by shearing and lifting of the sheared part from the plate body. Of course, the number and position of the elements 30 can be other than those illustrated. However, it has been ascertained that the illustrated structure offers the best connection characteristics.

Lateral indentations 16, intended to cooperate with the previously described anchoring elements 15 are also formed during the forming of the plate 8.

The plate 8 is made of a good conductive metallic material, such as, for example, a copper and zinc alloy which can be easily washed.

After the body of strip 2 has been formed by molding, the plates 8 are assembled on the strip, one for each seat 4 and by the anchoring means 11 and 15, they are firmly secured to the plate 8, so as to form a unitary piece. The plates 8 are mounted with the points 31 protruding from the strip 2, the number and the arrangement of the plates 8 mounted on the strip depending on the type and characteristics of the cables to be joined. Preferably, the depth of the grooves forming the seats 4 is substantially equal to the thickness of the plates 8 other than at the piercing elements 30.

Alternatively, the plates can be directly embedded in the strip 2 during the molding of the strip 2.

Preferably, the number of plates 8 is double the number of the wires 22 of a flat cable 20 or 21, so that each wire 22 is engaged with one plate 8 on each face. However, a sufficient mechanical and electrical connection can be obtained with one plate for each wire.

For example, in the connector 1 shown in FIG. 1, the cables 20 and 21 to be connected each comprises five wires, and therefore, all the five seats of each half of the connector are involved with the connection, requiring the use of 10 plates.

The same connector could be used also for interconnecting cables with fewer wires, for example, of the three-wire type. However, the plates in each half of the connector would be used, preferably, those which are nearest the folding line R. Also, if desired, the two outer plates 8 on each half could be omitted.

The butt joint between two flat cables is carried out as described hereinafter.

The strip 2, which carries the necessary number of plates 8, is arranged on the base of a press (not shown). The two ends of the flat cables 20 and 21 are positioned on the portion of strip 2 resting on the press base and are arranged end-to-end and maintained in position by elements present on the press base, such as grooves, clips, etc.

Preferably, the abutting line between the ends of the two flat cables 20 ad 21 coincides with the longitudinal axis of strip 2. However, it is possible to have an asymmetric positioning, i.e. one where the abutting line is not coincident with the strip axis. If necessary or desired, one or both channels 3 are filled with sealing material.

At this moment, the strip portion not covered by the cables 20 and 21 is folded along the folding line R so that it overlaps to the portion covered by the flat cables 20 and 21. The coupling formed by the tooth 7 and the aperture 6, when they are engaged, maintains the parts in position and ensures the correct alignment between the plates and the wires received between them.

The press is then manually actuated to press the assembly formed by the flat cables disposed between the two portions of the connector 1 so that the triangular points 31 perforate the insulation and penetrate into the underlying wires thereby providing an extremely firm electrical and mechanical connection.

Owing to the compression action, the anchoring means 11 are moved outwardly of the grooves forming the seats 4 and occupy the space defined by the recesses 12, whereas the anchoring means 15 are squeezed against the plates 8.

If sealing material was poured into the channels 3, it fills completely the duct they form, and any possible excess thereof is expelled during compression. When compression is discontinued, the two flat cables 20 and 21 are firmly joined together, both mechanically and electrically, through a connector of very reduced thickness.

Figure 10:
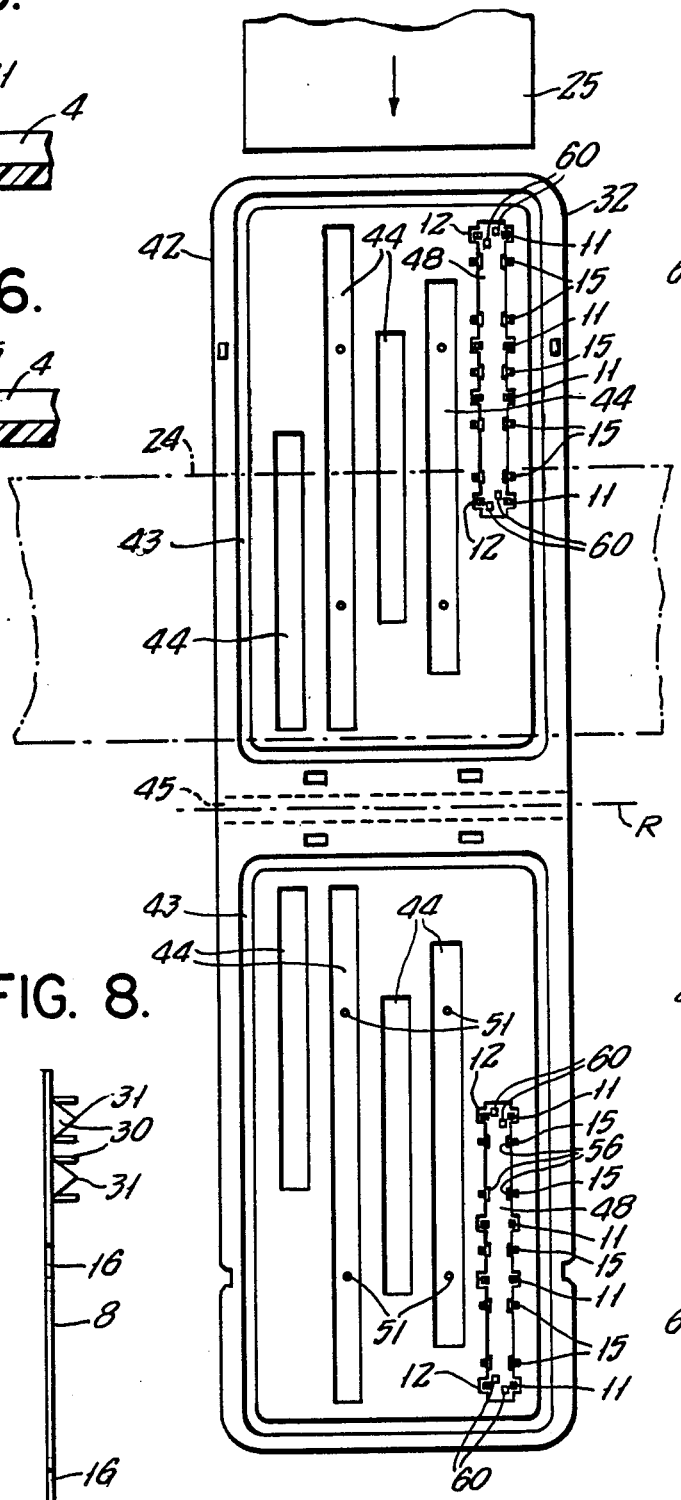
FIG. 10 is a plan view of a connector according to the invention for effecting a transverse or branch connection between flat cables.
Figure 11:
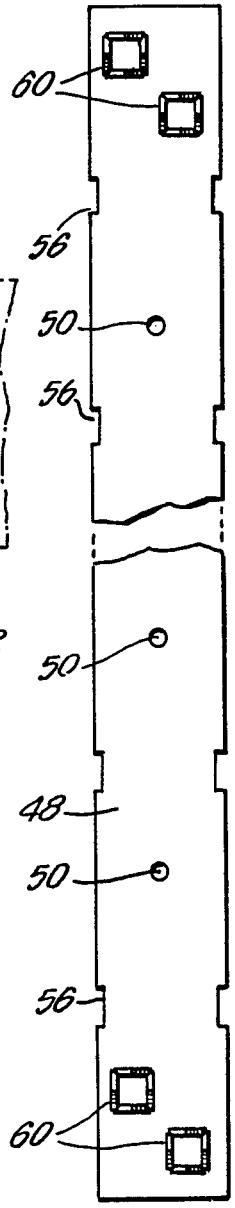
FIG. 11 is an enlarged plan view of a metal plate of the type used in the connector shown in FIG. 10.

FIGS. 10 and 11 illustrate a second embodiment which is able to effect transverse, or branch, connections between two flat cables. In this example, two flat cables of the five-wire type will be illustrated, namely, a flat cable 24 which could be defined as a "main", since it is not interrupted, and a shunt cable 25, which abuts orthogonally to the cable 24. Such a connection is used, for example, when branching from a single cable is necessary.

In general, the connector structure 32 is similar to the connector 1 described hereinbefore, as it comprises a strip 42 of insulating material having a central thinned part 45 which defines a transverse folding line R, and a plurality of longitudinal parallel seats 44, divided into two groups, each surrounded by a closed channel 43.

However, as distinguished from the butt joint connector 1, the parts defined by the folding line R have a length considerably greater than the width of the flat cables to be connected, the longitudinal seats are perpendicular to the folding line and have different lengths. However, the symmetry of the longitudinal seats with respect to the folding line R is maintained.

The anchoring elements 11 and 15 are repeated at a constant pitch and, therefore, the number thereof depends on the seat length.

The seats 44 in the connector 32 shown in FIG. 10 comprises connecting plates 48, one of which is shown in enlarged view in FIG. 11. The differences between plates 48 and plate 8 are that the plates 48 have a length greater than the width of the flat cable 24, are provided with a plurality of axial holes 50 and of lateral notches 56, the latter having a spacing corresponding to the spacing of the trapezoidal anchoring elements 15. The plates 48 also have pairs of elements 60 for the electrical and mechanical connection, which are substantially the same as the elements 30.

The plates 48 have a length substantially equal to the shortest of the grooves forming the longitudinal seats 44. The seats 44 are moreover provided with central pegs 51 (FIG. 10) which extend into the holes 50 so that the position of a plate 48 along the longer grooves which form the seats 44 can be varied. The plates 48 may also have different lengths, so as to be received and suitably arranged in the grooves according to the connection requirements. This allows the performance of different types of connections such as, for example, an ordered connection between the wires of the flat cables 24 and 25, or the connection of three wires only, or a connection with reversal or crossing of the wires themselves.

The various types of connection which can be obtained by means of the structure of FIG. 10, making use of plates 48 having equal or different lengths and appropriately arranged, will be evident to a technician skilled in this field and are not described in detail. It will be apparent that the invention attains the objects described. In fact, the structure and the construction of the connectors are extremely simple and inexpensive, and ensure connection of high reliability.

Further, the connectors are suitable for use with several types of flat cables, in particular, flat cables having different numbers of wires up to the maximum allowable number and may be used to carry out various connections between the wires of flat cables in a branch connection.

The thickness of the folded connector is very small in order not to create problems during installation and service. Finally, the construction of the connector does not require complicated devices or a particular skill on the part of an operator, since an appropriate tool, like a press, and the correct positioning of the cables to be connected are sufficient to permit expeditious installation of the connections.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. A connector for interconnecting flat electrical cables comprising a plurality of flat, coplanar and parallel wires embedded in a band-like insulating material, said connector comprising:

a strip of insulating material having a longitudinal axis and being foldable along a line traverse to said axis to provide two facing surfaces, said strip having a plurality of substantially parallel seats on at least one of said facing surfaces and which are spaced from each other to provide insulation between each seat and the next adjacent seat; and a plurality of conductive metal plates, one received in each of a plurality of said seats and secured to said strip and each of said plates being separated from each other by insulation of said strip and each of said plates having a plurality of perforating means thereon spaced from each other and extending outwardly of the facing surface which has the seat in which the plate is received for perforating the insulating material of a said cable disposed between said facing surfaces and for engaging said wires of a said cable when said facing surfaces are urged toward each other with a said cable therebetween;

whereby the same strip of insulating material with said seats and with said plates on said seats can be used to interconnect flat cables having different numbers of flat wires therein and having different spacings of the flat wires.

2. A connector as set forth in claim 1 wherein said strip has means extending from the facing surfaces thereof for engaging and holding said plates in said seats.

3. A connector as set forth in claim 1 wherein said strip has pegs within and extending from the bottom of at least one of said grooves and wherein at least the said plates received in grooves having said pegs have openings therein for receiving said pegs.

4. A connector as set forth in claim 1 wherein each of said perforating means comprises a plurality of projections with insulation material piercing points.

5. A connector as set forth in claim 1 wherein said strip further comprises a channel encircling said seats.

6. A connector as set forth in claim 1 wherein said strip has a reduced thickness at said transverse line.

7. A connector as set forth in claim 1 wherein each of said plates is secured to said strip by material of said strip.

8. A connector as set forth in claim 1 wherein said strip further comprises means at opposite sides of said transverse line which are interengageable when said strip is folded along said transverse line for aligning said facing surfaces.

9. A connector as set forth in claim 8 wherein one part of said means at one side of said transverse line is provided by an aperture in said strip remote from said transverse line and the other part of said means is a tooth at the other side of said transverse line and remote from said transverse line, said tooth extending into said aperture when said strip is folded along said transverse line.

10. A connector as set forth in claim 1 wherein said strip has relatively long and narrow and spaced grooves forming said seats and wherein the lengths of said grooves are substantially parallel to said transverse line.

11. A connector as set forth in claim 10 wherein said seats are on both said facing surfaces and are at least equal in number to twice the number of wires in a said cable, wherein said grooves have the same length and are arranged symmetrically with respect to said transverse line and wherein there is a said conductive metal plate in each of said grooves.

12. A connector as set forth in claim 1 wherein each plate has two spaced perforating means, wherein one of said perforating means of each said plates is aligned with one of said perforating means of the other of said plates along a line substantially perpendicular to said transverse line and the other of said perforating means of each plate is aligned with the other of said perforating means of the others of said plates along a line substantially perpendicular to said transverse line.

13. A connector as set forth in claim 12, wherein each of said plates has the same length and a length substantially equal to the length of the seats in which they are received.

14. A connector as set forth in claim 1 wherein said strip has relatively long and narrow and spaced grooves forming said seats and wherein the lengths of said grooves are substantially perpendicular to said transverse line.

15. A connector as set forth in claim 14 wherein at least one of said plates has a length smaller than the length of the groove in which it is received.

16. A connector as set forth in claim 14 wherein said seats are on both said facing surfaces and are at least equal in number to twice the number of wires in a said cable, wherein said grooves have different lengths and are arranged symmetrically with respect to said transverse line and wherein there is a said conductive plate in each of said grooves.

* * * * *